US011248755B2

(12) United States Patent
Sreshta et al.

(10) Patent No.: US 11,248,755 B2
(45) **Date of Patent: *Feb. 15, 2022**

(54) INFLATABLE SOLAR-POWERED LIGHT

(71) Applicant: LUMINAID LAB LLC, Houston, TX (US)

(72) Inventors: Andrea M. Sreshta, Houston, TX (US); Anna Ruth Stork, Sherborn, MA (US)

(73) Assignee: LuminAID LAB, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/643,519

(22) Filed: Mar. 10, 2015

(65) Prior Publication Data

US 2015/0219294 A1 Aug. 6, 2015
US 2017/0211760 A9 Jul. 27, 2017

Related U.S. Application Data

(63) Continuation-in-part of application No. 13/163,239, filed on Jun. 17, 2011, now abandoned, and a (Continued)

(51) Int. Cl.
*F21L 4/08* (2006.01)
*F21S 9/03* (2006.01)
(Continued)

(52) U.S. Cl.
CPC ..... *F21L 4/08* (2013.01); *A63B 43/06* (2013.01); *F21S 9/037* (2013.01); *F21V 3/02* (2013.01);
(Continued)

(58) Field of Classification Search
CPC ..... F21V 33/009; F21V 33/004; F21V 17/00; F21V 3/00; F21V 15/02; F21V 14/045;
(Continued)

(56) References Cited

U.S. PATENT DOCUMENTS 2,245,715 A 6/1941 Rieck
3,553,866 A 1/1971 Redford et al.
(Continued)

FOREIGN PATENT DOCUMENTS

CA 152065 5/2014
CN 1162496 10/1997
(Continued)

OTHER PUBLICATIONS

Nonfinal Office Action, U.S. Appl. No. 13/450,974, dated Mar. 17, 2015.
(Continued)

*Primary Examiner* — Anabel Ton
(74) *Attorney, Agent, or Firm* — Fish & Richardson P.C.

(57) ABSTRACT

An inflatable solar-powered light is provided. The solar-powered light includes a bladder and a solar-powered light assembly disposed entirely within the bladder. The solar-powered light assembly includes a solar panel, a rechargeable battery in electrical communication with the solar panel, and at least one light-emitting diode in electrical communication with the rechargeable battery. The bladder is substantially transparent, flexible, inflatable, and collapsible.

18 Claims, 8 Drawing Sheets

Related U.S. Application Data continuation-in-part of application No. 14/397,722, filed as application No. PCT/US2012/061848 on Oct. 25, 2012, now Pat. No. 9,347,629.

(60) Provisional application No. 61/640,769, filed on May 1, 2012, provisional application No. 61/356,274, filed on Jun. 18, 2010.

(51) Int. Cl.

| | |
|---|---|
| ***F21V 31/00*** | (2006.01) |
| ***F21V 23/00*** | (2015.01) |
| ***F21V 23/04*** | (2006.01) |
| ***A63B 43/06*** | (2006.01) |
| ***F21V 3/02*** | (2006.01) |
| ***F21V 3/06*** | (2018.01) |
| *A63B 41/00* | (2006.01) |
| *F21W 111/10* | (2006.01) |
| *F21Y 115/10* | (2016.01) |

(52) U.S. Cl.

CPC ..... *F21V 3/026* (2013.01); *F21V 3/062* (2018.02); *F21V 3/0625* (2018.02); *F21V 23/005* (2013.01); *F21V 23/04* (2013.01); *F21V 23/0414* (2013.01); *F21V 31/00* (2013.01); *F21V 31/005* (2013.01); *A63B 41/00* (2013.01); *F21W 2111/10* (2013.01); *F21Y 2115/10* (2016.08)

(58) Field of Classification Search

CPC . F21V 1/06; F21V 17/007; F21V 1/00; F21V 31/005; F21V 3/026; F21V 31/00; F21V 3/02; F21V 23/005; F21V 23/04; F21V 23/0414; F21Y 2101/02; F21L 4/085; F21L 4/08; F21L 4/00; F21L 7/00; F21L 8/08; F21S 9/037; A63B 41/00; A63B 41/06

USPC ..... 362/96, 183, 189, 352, 363

See application file for complete search history.

(56) References Cited

U.S. PATENT DOCUMENTS 4,243,432 A * 1/1981 Jordan ..... H01L 31/03365 136/244
4,503,563 A 3/1985 Johnson
4,692,557 A * 9/1987 Samuelson ..... B32B 17/10678 136/251
4,979,339 A 12/1990 Jones et al.
5,083,250 A * 1/1992 Malcolm ..... 362/253
5,231,781 A * 8/1993 Dunbar ..... 43/17.5
5,427,258 A 6/1995 Krishnakumar et al.
5,603,648 A 2/1997 Kea
5,782,552 A 7/1998 Green et al.
D397,470 S 8/1998 Bassford et al.
5,888,156 A 3/1999 Cmiel et al.
5,890,794 A 4/1999 Abtahi et al.
5,947,581 A * 9/1999 Schrimmer ..... A63H 27/10 362/189
6,013,985 A 1/2000 Green et al.
6,018,960 A 2/2000 Parienti
6,027,225 A 2/2000 Martin et al.
6,193,392 B1 2/2001 Lodhie
6,200,000 B1 3/2001 Burnidge
6,254,247 B1 7/2001 Carson
6,276,815 B1 8/2001 Wu
6,280,344 B1 * 8/2001 Robb ..... 473/125
6,371,637 B1 4/2002 Atchinson et al.
D465,874 S 11/2002 Garvin et al.
6,499,857 B1 12/2002 Lumley
6,502,953 B2 1/2003 Hajianpour
D485,003 S 1/2004 Olson
7,318,656 B1 1/2008 Merine
7,322,137 B2 1/2008 Machala
7,377,667 B2 5/2008 Richmond
7,458,698 B2 12/2008 Heathcock
7,500,746 B1 * 3/2009 Howell ..... G02C 11/00 351/158
7,611,396 B2 11/2009 Schnuckle
7,690,812 B2 4/2010 Roberts et al.
7,699,495 B2 4/2010 Au
D627,090 S 11/2010 Sanoer
7,825,325 B2 11/2010 Kennedy et al.
7,857,490 B1 12/2010 Fett et al.
D639,494 S 6/2011 Schrimmer et al.
8,011,816 B1 9/2011 Janda
8,550,663 B2 * 10/2013 Tong ..... F21V 19/0005 362/249.16
D694,445 S 11/2013 Shiu
D706,968 S 6/2014 Mcdonough et al.
9,022,614 B2 5/2015 Chin-Huan
9,200,770 B2 12/2015 Chun
9,347,629 B2 * 5/2016 Stork ..... F21V 31/005
2002/0085329 A1 7/2002 Lee
2003/0169590 A1 9/2003 Sorli et al.
2004/0130888 A1 7/2004 Twardawski
2005/0002188 A1 1/2005 Bucher et al.
2005/0007773 A1 1/2005 Shirataki et al.
2005/0261091 A1 11/2005 Buschfort
2005/0265029 A1 12/2005 Epstein et al.
2006/0108612 A1 5/2006 Richmond
2006/0193126 A1 8/2006 Kuelbs et al.
2006/0221595 A1 10/2006 Payne
2006/0279956 A1 12/2006 Richmond
2006/0291217 A1 12/2006 Vanderschuit
2007/0014125 A1 1/2007 Chu
2007/0091594 A1 4/2007 Soon
2007/0109772 A1 5/2007 Chang
2007/0147063 A1 6/2007 Collomb et al.
2007/0183143 A1 9/2007 Allsop et al.
2008/0013317 A1 1/2008 Hinds
2008/0032589 A1 2/2008 Sun
2008/0130272 A1 6/2008 Waters
2008/0175005 A1 * 7/2008 Kellmann et al. ..... 362/352
2008/0175006 A1 7/2008 Kellmann et al.
2008/0266860 A1 * 10/2008 Marcinkewicz ..... B63B 45/02 362/253
2008/0273319 A1 * 11/2008 VanderSchuit ..... 362/101
2008/0311820 A1 12/2008 Murdock
2009/0053946 A1 2/2009 Ashby
2009/0133636 A1 5/2009 Richmond
2009/0141491 A1 6/2009 Chu
2009/0175029 A1 7/2009 Chiang
2009/0268439 A1 10/2009 Chen
2009/0269045 A1 10/2009 Astill
2009/0322495 A1 12/2009 Richmond
2010/0286910 A1 11/2010 Hudson
2010/0308005 A1 12/2010 Callanan
2011/0018439 A1 1/2011 Fabbri et al.
2011/0118062 A1 5/2011 Krysiak et al.
2012/0069554 A1 * 3/2012 Toya ..... F21L 4/00 362/158
2012/0120642 A1 5/2012 Sreshta et al.
2012/0134143 A1 5/2012 Lederer et al.
2012/0193660 A1 8/2012 Donofrio et al.
2012/0200235 A1 8/2012 Shuy et al.
2012/0224359 A1 * 9/2012 Chun ..... F21S 8/00 362/183
2013/0107506 A1 5/2013 Mustafa
2013/0187569 A1 7/2013 Chin-Huan
2014/0118997 A1 5/2014 Snyder
2016/0341380 A1 11/2016 Stork et al.

FOREIGN PATENT DOCUMENTS

CN 101576204 11/2009
CN 101690402 3/2010
CN 101731815 A * 6/2010
CN 201523778 U * 7/2010
CN 101886746 11/2010

(56) References Cited

FOREIGN PATENT DOCUMENTS

| | | | |
|---|---|---|---|
| CN | 201715273 | | 1/2011 |
| CN | 102116415 | | 7/2011 |
| CN | 102379502 | | 3/2012 |
| CN | 102403929 | | 4/2012 |
| CN | 202203682 | | 4/2012 |
| CN | 202511013 | | 10/2012 |
| DE | 20209138 | | 9/2002 |
| DE | 10 2006 022185 | | 11/2007 |
| EP | 002289363-0001 | | 8/2013 |
| JP | 2000057808 | | 2/2000 |
| JP | 2006047829 | | 2/2006 |
| JP | 2006201307 | | 8/2006 |
| JP | 2009278763 | | 11/2009 |
| WO | WO-0183067 | A2 | 11/2001 |
| WO | WO 2006/070724 | | 6/2006 |

OTHER PUBLICATIONS

Nonfinal Office Action, U.S. Appl. No. 13/163,239, dated Apr. 24, 2015.
Nonfinal Office Action, U.S. Appl. No. 13/163,239, dated Jun. 5, 2013.
International Search Report and Written Opinion from International Application No. PCT/US12/61848 dated Jan. 8, 2013.
D Light Nova S100, Nova Series, www.dlightdesign.com/products, printed Jun. 15, 2011.
D Light Kiran Lantern, www.dlightdesign.com/products, printed Jun. 15, 2011.
Portable Light Project, http://portablelight.org, printed Jun. 16, 2011.
Floating Solar Pool Light, www.brandsonsale.com, printed Jun. 16, 2011.
Mini-BoGo Flashlight, www.bogolight.com/productdetails, printed Jun. 16, 2011.
Sreshta, Andrea M., et al., Solar-Powered Inflatable Light, Kauffman Innovation Network, Inc., Copyright 2011, www.ibridgenetwork.org/columbia, printed Jun. 16, 2011.
Australian Office Action in Australian Application No. 2017200735, dated Feb. 12, 2018, 3 pages.
Chinese Second Office Action in Chinese Application No. 201288072931.1, dated Feb. 26, 2018, 12 pages, with English Translation.
U.S. Appl. No. 61/356,274, Sreshta.
'bbc.com' [online]. "Lantern shines light on disasters," available on or before Feb. 29, 2012, via Internet Archive: Wayback Machine URL <https://web.archive.org/web/20120229073911/http://www.bbc.com/future/story/20120207-lantern-shines-light-on-disasters>, URL<http://www.bbc.com/future/story/20120207-lantern-shines-light-on-disasters>, 2 pages.
Boyd, "LuminAID Shining a light on disasters," Published on Feb. 14, 2012, [retrieved on Mar. 1, 2019], retrieved from the Internet: URL:<https://www.bbc.com/future/story/20120207-lantern-shines-light-on-disasters>. 11 page.
European Communication of Notice of Opposition, in European Application No. 12875772.1, dated Jan. 18, 2019, 23 pages.
Exhibit documents from IPR2018-01524, filed Aug. 8, 2018, 2132 pages.
'Indiegogo.com' [online]. "LuminAID: An Inflatable Solar Light, Story" Published on Feb. 15, 2012, retrieved from the Internet: URL:<https://www.indiegogo.com/projects/luminaid-an-inflatable-solar-light--3#/updates/all>. 1 page.
'Indiegogo.com' [online]. "LuminAID: An Inflatable Solar Light, Updates" Published on Feb. 15, 2012, retrieved from the Internet: URL:<https://www.indiegogo.com/projects/luminaid-an-inflatable-solar-light--3#/updates/all>. 1 page.
Korean Office Action in Korean Application No. 10-2014-7033620, dated Sep. 27, 2018, 14 pages, English Translation.
Korosec, "An Inflatable Solar light For Disaster Relief (or Camping)," [online]. Published on Nov. 17, 2011, [retrieved on Dec. 18, 2018], retrieved from the Internet: URL:<https:/www.zdnet.com/article/an-Inflatable-solar-light-for-distaster-relief-or-camping/>. 11 pages.
'luminaidlab.com' [online]. "LuminAID The World's First Inflatable Solar Light," available on or before Jan. 21, 2012, via Internet Archive: Wayback Machine URL <https://web.archlve.org/web/20120121014311//http:/luminaidiab.com:80/blog/>, URL<http:/luminaidiab.com:80/blog/>, 6 pages.
Mpowerd Inc. v. LuminAID Lab, LLC, IPR2018-01524, "Petition for Inter Partes Review of U.S. Pat. No. 9,347,629", dated Aug. 8, 2018, 71 pages.
Piejko, "LuminAID solar-powered inflatable lantern—simply a good idea," Published on Nov. 15, 2011, [retrieved on Dec. 14, 2018], retrieved from the Internet: URL:<https://newatlas.com/luminald-solar-powered-lamp/20501/> 2 pages.
Cumberbatch et al., "Self-Assembled Solar Lighting Systems", Oct. 11, 2009, Proc.ISES Solar World Congress, pp. 1-10.
International Search Report for International Application No. PCT/US2016/014222, dated Apr. 8, 2016 (2 pages).
Jonsson, J. Project Soul Cell, YouTube, Oct. 28, 2009 (1 page). Retrieved from the Internet: <URL: https://www.youtube.com/watch?v=DG71kgUUr4M>.
Lichauco De Leon, "Sunlight-powered 'bulbs' made from plastic bottles light up homes." The Guardian, Dec. 23, 2011, p. 1-2, Retrieved from the Internet: <URL: https://www.theguardian.com/environment/2011/dec/23/sunlight-bulbs-plastic-bottles-light>.
Office Action in Australian Application No. 2012378999, dated Dec. 19, 2016, 4 pages.
Office Action in European Application No. 12875772.1, dated Nov. 7, 2016, 5 pages.
Office Action in European Application No. 12875772.1, dated Mar. 31, 2017, 6 pages.
Oskay, W., 'Simple Solar Circuits' [Viewed on internet on Dec. 19, 2016], http://www.evilmadscientist.com/2008/simple-solar-circuits/, Published Oct. 22, 2008, 13 pages.

* cited by examiner

INFLATABLE SOLAR-POWERED LIGHT

CROSS REFERENCE TO RELATED APPLICATION(S)

This application claims priority to U.S. Non-Provisional application Ser. No. 14/397,722, filed Oct. 29, 2014, which is a National Stage application of International Publication No. PCT/US2012/061848, filed Oct. 25, 2012, which claims priority to U.S. Provisional Application No. 61/640,769, filed May 1, 2012, the disclosures of which are hereby incorporated by reference in their entirety.

BACKGROUND

Restoring normal life in regions affected by natural disasters or war plays a vital role in recovery efforts. Re-establishing electrical grid infrastructure in those cases can sometimes take weeks or months. There is a need for a solution that can be deployed easily and immediately and with minimal maintenance. Sustainable lighting solutions, including photovoltaic cells coupled to rechargeable batteries, are an ideal approach to providing on-demand lighting with no operating cost. However, current solar-charged light solutions are expensive and difficult to manufacture and transport. This makes them unattractive for large-scale deployment.

One in six people in the world lack stable access to electricity. Many people must rely on dangerous and toxic kerosene lamps as a primary source of light and spend upwards of 30% of their income on this kerosene. With the increasing developments in small scale solar technology, there is no reason why individuals and families should not have a safer, less expensive, and more reliable source of light.

Battery or fuel-powered lighting solutions have the obvious disadvantage of recurring cost and limited resources. On the other hand, most renewable lighting solutions require expensive components and are large and difficult to ship.

SUMMARY

An inflatable solar-powered light is provided. The solar-powered light includes a bladder and a solar-powered light assembly disposed entirely within the bladder. The solar-powered light assembly includes a solar panel, a rechargeable battery in electrical communication with the solar panel, and at least one light-emitting diode in electrical communication with the rechargeable battery. The bladder is substantially transparent, flexible, inflatable, and collapsible.

BRIEF DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION

Referring now to FIGS. 1-9, aspects of the disclosed subject matter include an inflatable solar-powered light 100 including an expandable bladder 102, a solar-powered light assembly 104, and a cover portion 106. The light is expandable by filling bladder 102 with a gas, liquid, or solid.

Figure 1:
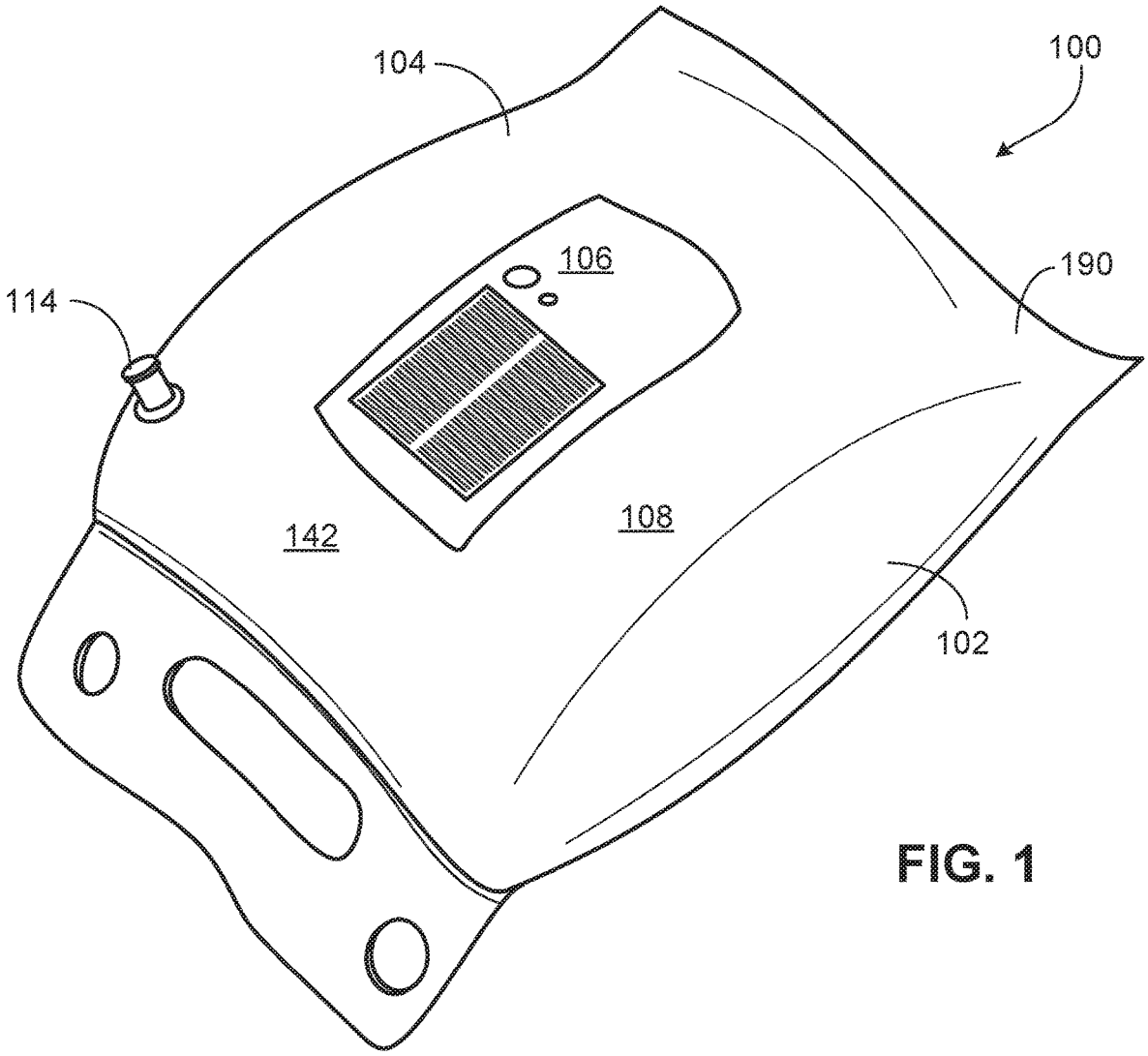
FIG. 1 is a front isometric view of a solar-powered light according to some embodiments of the disclosed subject matter.
Figure 10:
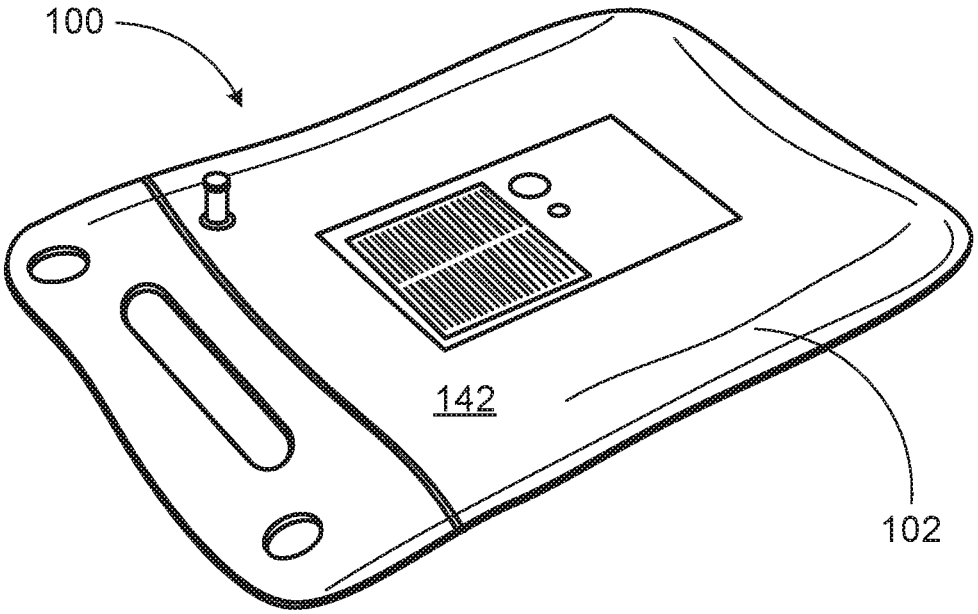
FIG. 10 is a front isometric view of a solar-powered light in a flat state according to some embodiments of the disclosed subject matter.
Figure 11:
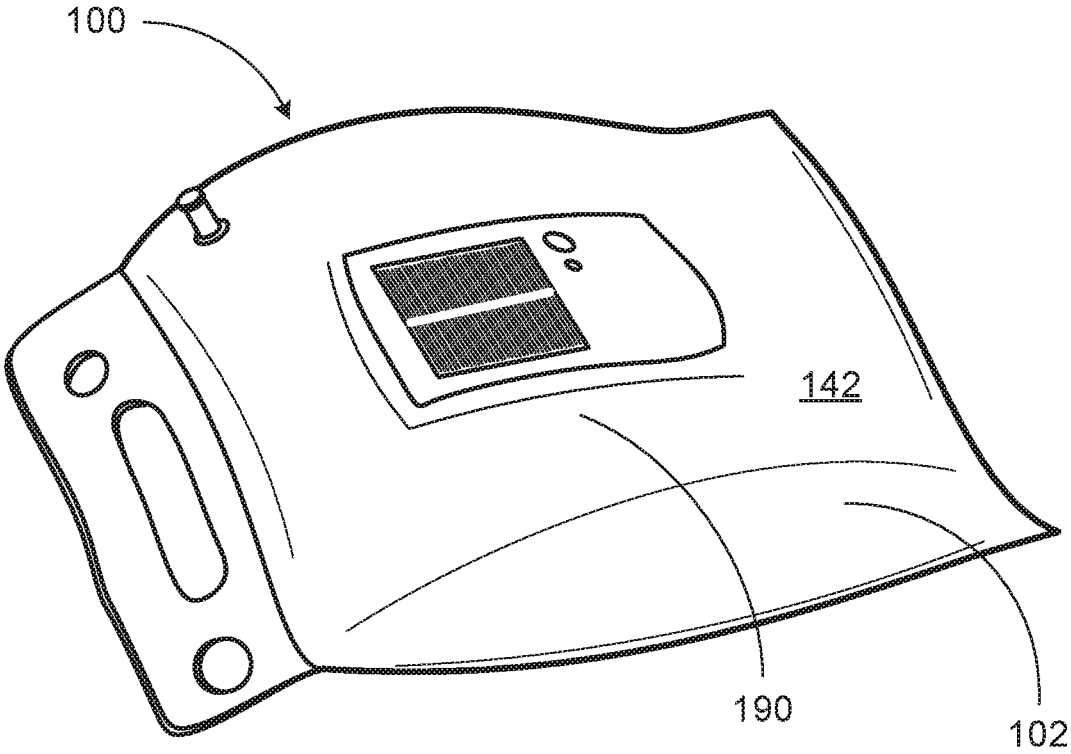
FIG. 11 is a front isometric view of a solar-powered light in an expanded state according to some embodiments of the disclosed subject matter.

As best shown in FIGS. 2-5, in some embodiments, bladder 102 has a plurality of surfaces 108 including at least inside and outside surfaces 110 and 112, respectively. In some embodiments, bladder 102 includes a valve 114 through which the bladder can be expanded and collapsed by inflating filling and deflating or emptying, respectively. The interior of the bladder comprises a first volume 190, as shown in FIGS. 1 and 11. Bladder 102 is typically filled with one or more of a gas, e.g., air, liquid, and solid. For example, as shown in FIG. 10, in a first state, bladder 102 is substantially free of gas, liquids, and solids and light 100 is substantially collapsed. Conversely, as shown in FIG. 11, in a second state, bladder 102 includes one or more of a gas, liquid, and solid and light 100 is substantially expanded.

In some embodiments, inflatable bladder 102 is mainly made of thin, plastic based materials that are waterproof, foldable, and can be manufactured with the simple process of heat-sealing. In some embodiments, two layers of semi-transparent PVC material are sealed together on four sides to form bladder 102. In some embodiments, inflatable bladder 102 is made out of one or more of silicone, Mylar, or other materials that expand and contract. Bladder 102 is typically sealable so that light 100 floats.

Figure 2:
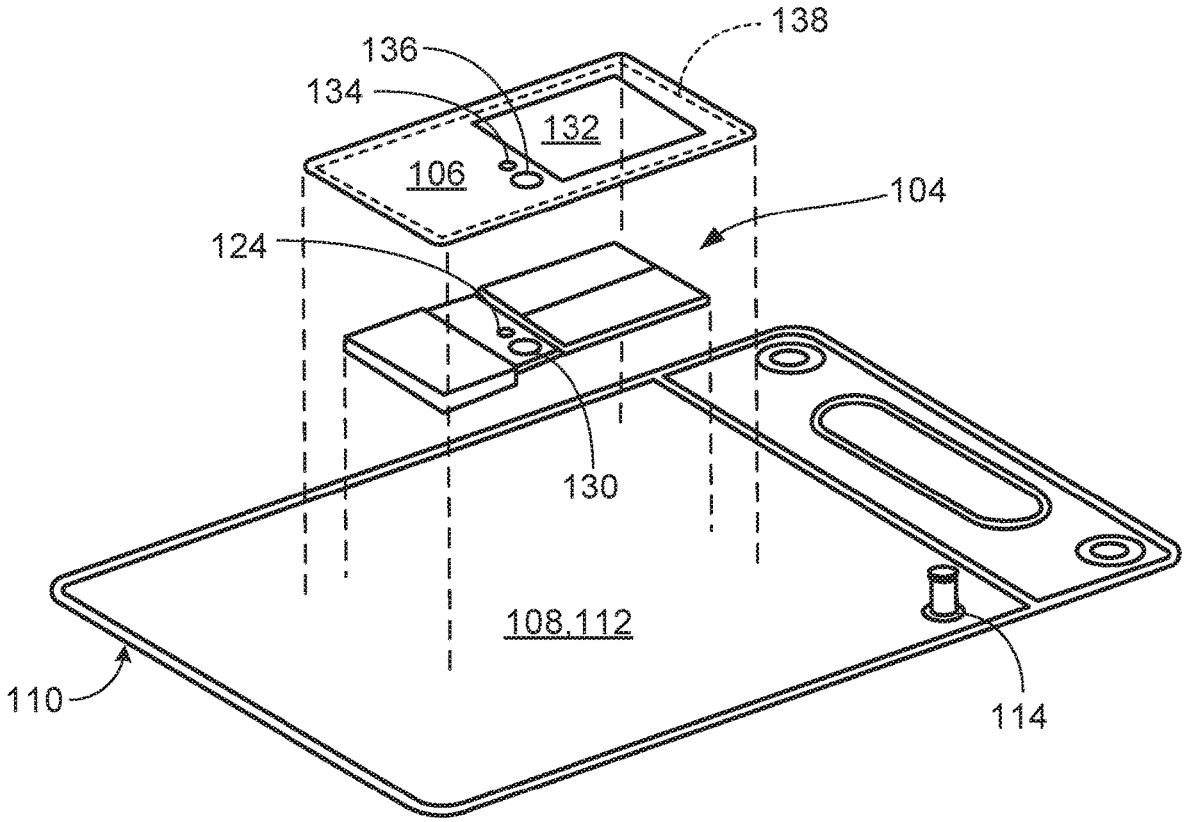
FIG. 2 is a front isometric exploded view of a solar-powered light according to some embodiments of the disclosed subject matter.
Figure 3:
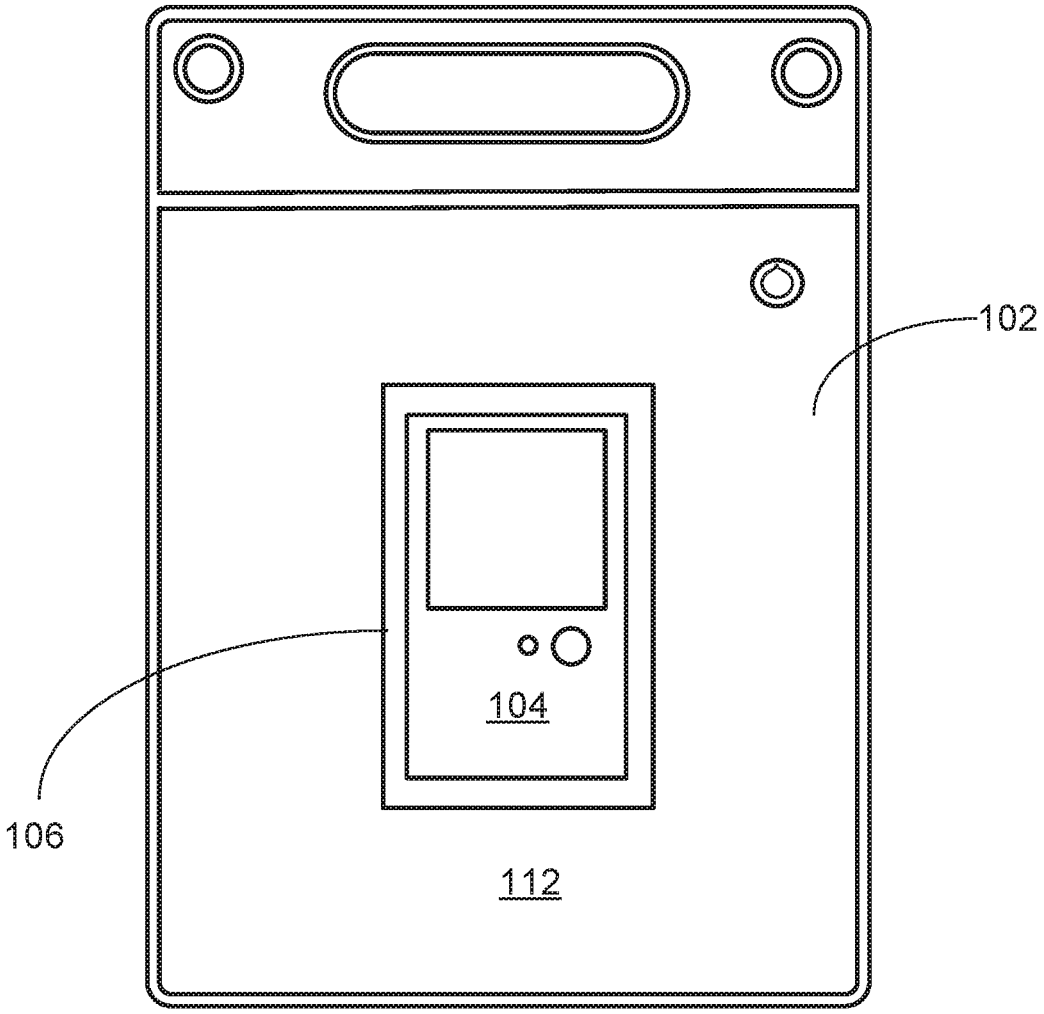
FIG. 3 is a front view of a solar-powered light according to some embodiments of the disclosed subject matter.
Figure 4:
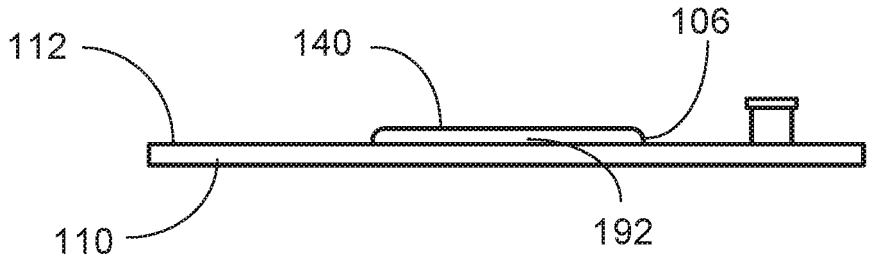
FIG. 4 is a side view of a solar-powered light according to some embodiments of the disclosed subject matter.
Figure 5:
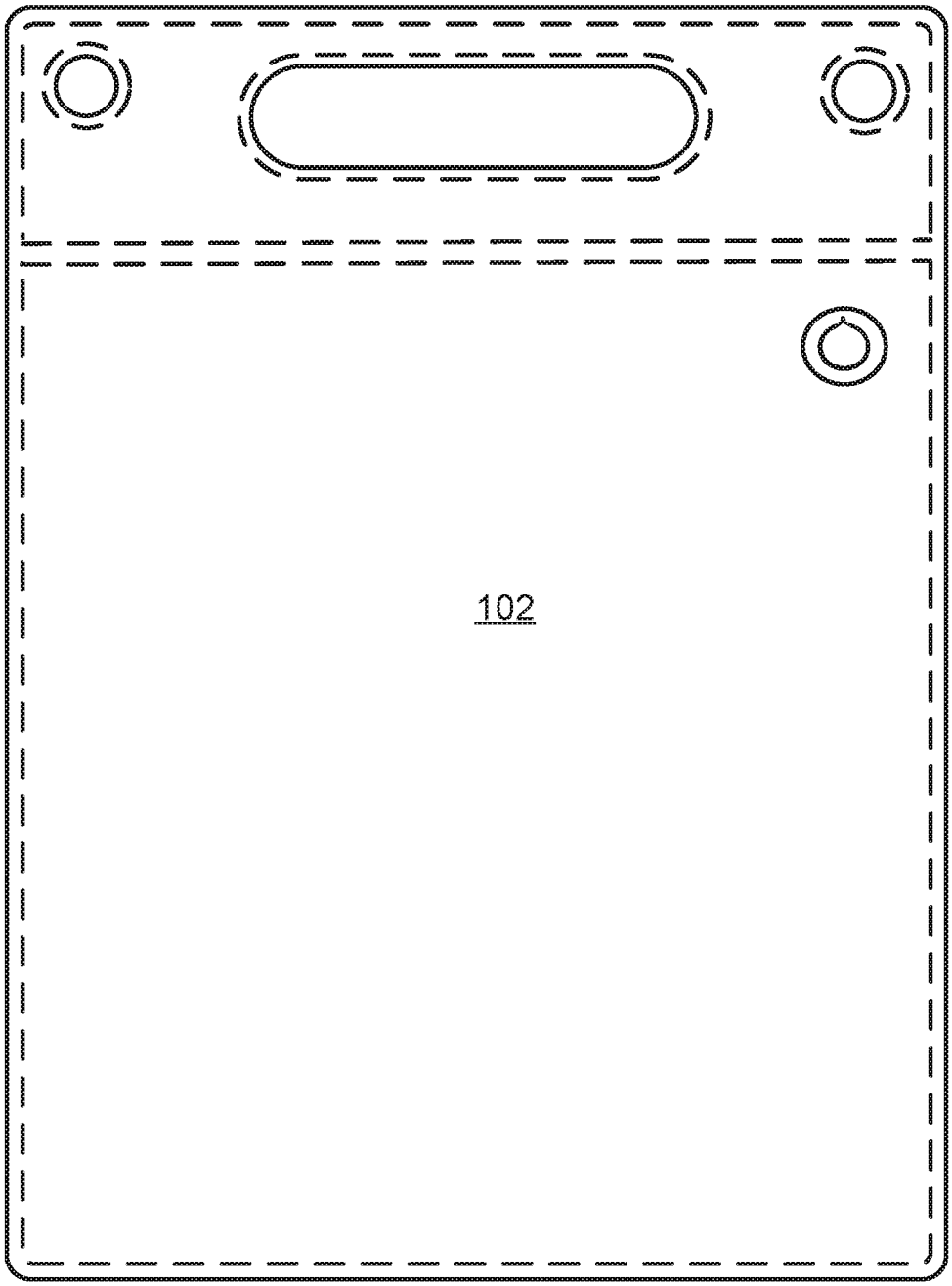
FIG. 5 is a front view of a bladder of a solar-powered light according to some embodiments of the disclosed subject matter.
Figure 6:
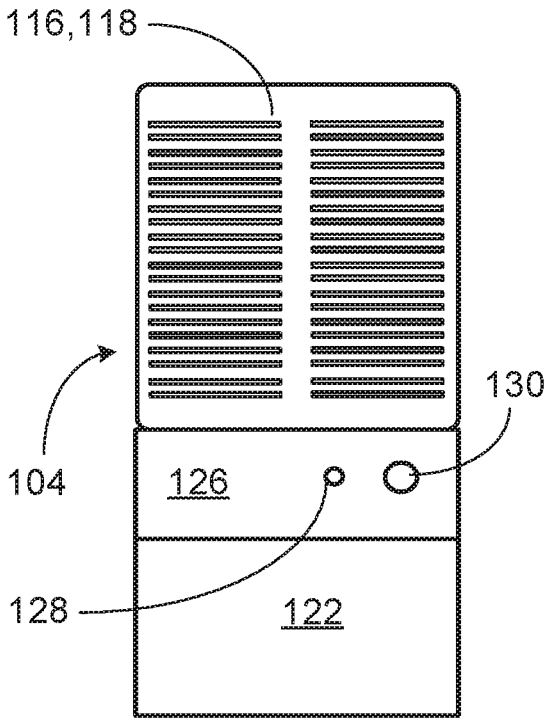
FIG. 6 is a front view of a solar-powered light assembly of a solar-powered light according to some embodiments of the disclosed subject matter.
Figure 7:
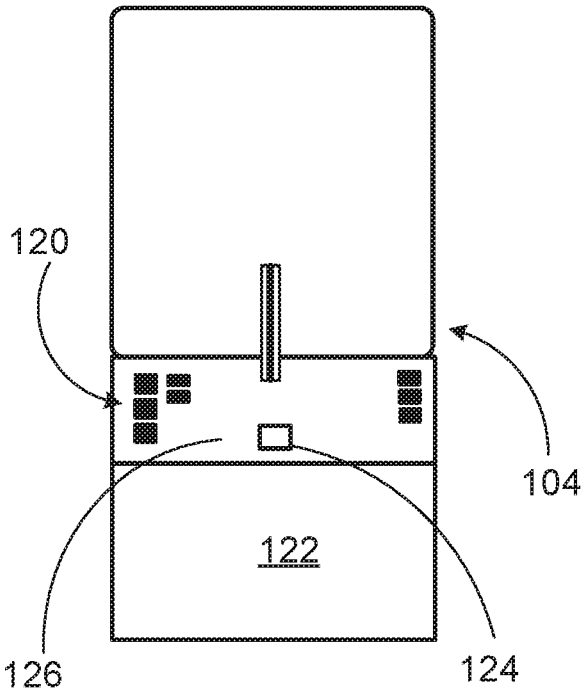
FIG. 7 is a back view of a solar-powered light assembly of a solar-powered light according to some embodiments of the disclosed subject matter.
Figure 8:
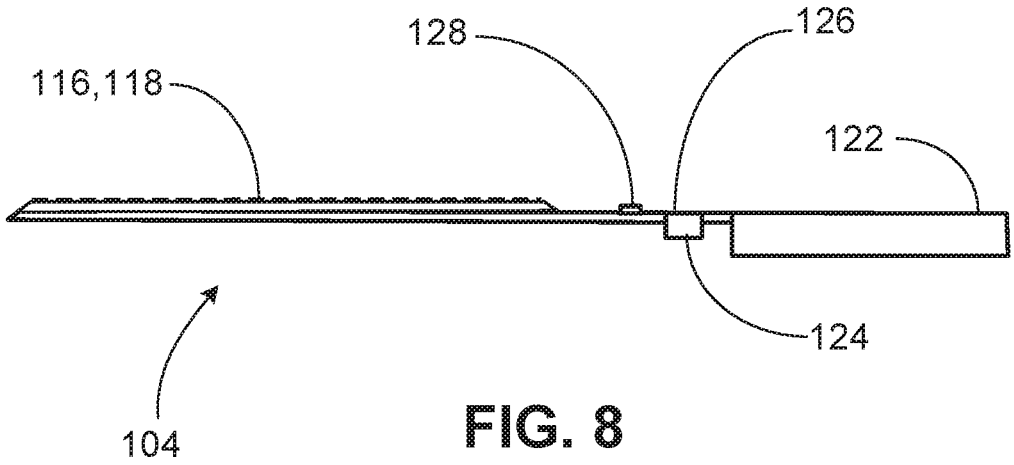
FIG. 8 is a side view of a solar-powered light assembly of a solar-powered light according to some embodiments of the disclosed subject matter.
Figure 9:
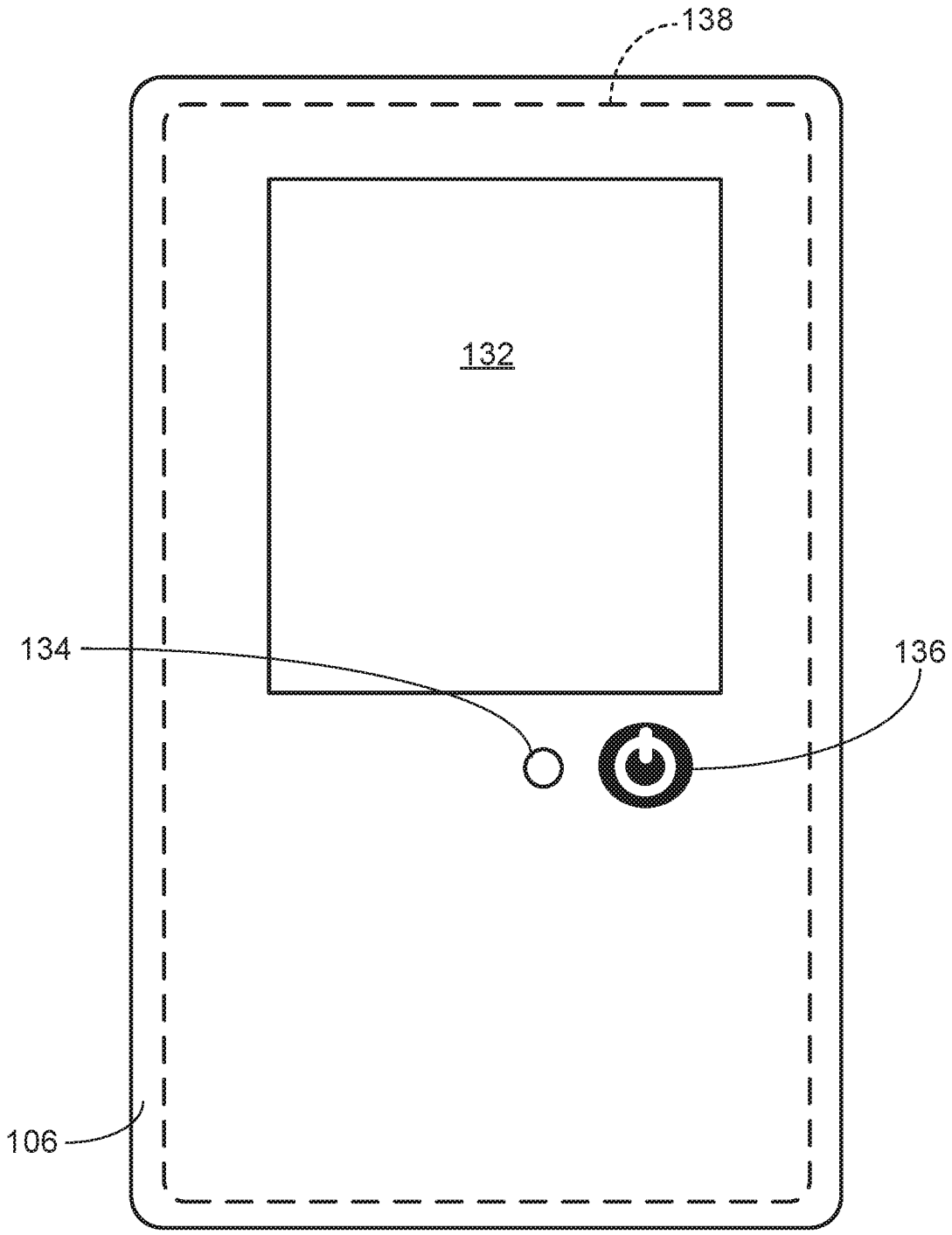
FIG. 9 is a front view of a cover portion of a solar-powered light according to some embodiments of the disclosed subject matter.

As best shown in FIGS. 2-4, solar-powered light assembly 104 is positioned on or adjacent to or joined with one of inside 110 and outside 112 surfaces of bladder 102, e.g., on an outside surface in this embodiment. Referring now to FIGS. 6-8, solar-powered light assembly 104 includes one or more flexible or rigid solar panels 116, e.g., a photovoltaic panel 118, a battery charger 120 in electrical communication with the solar panel, one or more rechargeable batteries 122 in electrical communication with the battery charger, and one or more light emitting diodes (LED) 124 in electrical communication with the rechargeable batteries. Battery charger 120 is typically positioned with one or more of the other components of assembly 104 on a support element, e.g., a printed circuit board (PCB) 126, which typically includes overcharge control, e.g., comprising one or more resistors and capacitors (not shown), to prevent overcharging rechargeable battery 122 and to control the flow of current to LED 124. In some embodiments, rechargeable batteries 122 include two 3.7 volt coin cell batteries, e.g., 3.7V 680 mAh Li-Ion Polymer. Of course, other size batteries are contemplated depending on the particular application.

In some embodiments, solar-powered light assembly 104 includes multiple, contiguous or non-contiguous portions positioned on the same or different surfaces of bladder 102, e.g., solar panel 116 and PCB 126 are divided or separated onto two or more surfaces of the bladder. For example, in some embodiments, light 100 is cube-shaped and solar panel 116 is on one side of the cube shape and PCB 126 with a press button is positioned on another side of the cube shape.

As mentioned above, in some embodiments, solar-powered light assembly 104 includes PCB 126. As discussed more below, in some embodiments, PCB 126 contains light-emitting diode 124, a small red LED 128 to indicate charging, a switch 130 to turn OFF/ON the main LED, and several resistors and capacitors (not shown) to prevent overcharging the battery and to control the flow of current to the LEDs.

In some embodiments, assembly 104 includes more than one LED 124, e.g., four LEDs, in electrical communication with the rechargeable batteries. Embodiments including more than one LED typically have an increased viewing angle, e.g., four LEDs provides about a 100 to 120 degree viewing angle, which provide approximately 30-40 lumens of light. In some embodiments, assembly 104 includes power switch 130, which is in electrical communication with the rechargeable batteries 122 and LEDs 124. Switch 130 is configured to selectively introduce and prevent the flow of electricity from batteries 122 to LEDs 124. Switch 130 is configured so that a user can control an amount of light output by light 100, e.g., via off, low, and high settings. This can be achieved in at least two ways. First, where there is more than one LED 124, switch 130 can be configured so as to selectively introduce and prevent the flow of electricity from batteries 122 to a desired number of LEDs 124. Alternatively, regardless of the number of LEDs 124, switch 130 can be configured to selectively regulate the flow of electricity from batteries 122 to LEDs 124.

In some embodiments, switch 130 is configured to prevent accidental turn-on, e.g., has enough resistance to being switched and is concave. As mentioned above, some embodiments include charging lights for indicating whether batteries 122 are charged, e.g., LEDs 128 that glow red when the batteries are charging or is when the batteries are fully charged. Charging lights, i.e., LED 128, are in communication with battery charger 120. In some embodiments, depending on the size of solar panel 116, the strength of batteries 122, and number of LEDs 124, the batteries will provide enough power to energize the LEDs for 8 hours on a low setting and 4-6 hours on a high setting, and the batteries will recharge after 5-8 hours in the sun.

Referring now to FIGS. 2-4 and 9, in some embodiments, on or more of cover portion 106 are made of a clear PVC material and include printing on the underside. Cover portion 106 protects and secures solar-powered light assembly 104. Cover portion 106 has a clear window 132 over solar panel 116 to allow for charging. Cover portion 106 also has clear windows 134 over LEDs 124 to allow the light to shine through the cover portion and a red circle 136 to indicate where switch 130 is located on PCB 126. Cover portion 106 is positioned over assembly 104 and joined with at least one of plurality of surfaces 108 of bladder 102 around its edges 138. Cover portion 106 forms a substantially waterproof envelope 140 with at least one of plurality of surfaces 108 of bladder 102, forming a second volume 192 as shown in FIG. 4, in which solar-powered light assembly 104 is contained. In some embodiments, at least a portion of cover portions 106 are substantially transparent.

In some embodiments, multi-layered cover portions 106 may be used or multiple cover portions positioned on the same or different surfaces 108 of bladder 102, e.g., each cover portion covers a different portion of a multi-portion solar-powered light assembly 104. In some embodiments (not shown), cover portion 106 is defined by a thin, plastic box that encloses light assembly 104. The box is welded/melted to inside 110 or outside surface 112 of bladder 102. In some embodiments, light assembly 104 is held within an inner pocket (not shown) that is formed on inside surface 110 of bladder 102. In some embodiments, cover portion 106 includes an open window (now shown) in the cover, i.e., the cover portion is not a complete surface. In some embodiments, cover portion 106 is substantially opaque and covers the PCB 126, but solar panel 116 is positioned on and joined with a different one surfaces 108 of bladder 102 than the PCB.

As discussed above, inflatable bladder 102 is typically configured to diffuse light to reduce glare and create an ambient light source. In some embodiments, LEDs 124 are positioned so they shine directly into inflatable bladder 102. As best shown in FIGS. 1, 10, and 11, in some embodiments, bladder 102 is fabricated from a semi-transparent material such as a frosted plastic material 142 or similar to promote diffusion of light from LEDs 124. In some embodiments, bladder 102 includes one or more surfaces having a particular pattern (not shown) configured to promote diffusion of light from LEDs 124. In some embodiments, the particular pattern includes a white background portion having a grid of transparent portions that cover about thirty percent of the transparent white pattern.

In some embodiments, bladder 102 is substantially shaped like a pillow. In some embodiments, bladder includes 102 a bottom portion that has a flat bottom surface and a top portion defining a handle. The flat bottom surface generally allows the light to be positioned so as to stand in an upright position. Both bladder 102 and cover portion 106 are generally fabricated from materials that are substantially transparent, flexible, inflatable, and collapsible.

Lights according to the disclosed subject matter offer benefits over known technology. In the wake of a natural disaster, because they are collapsible, they can be shipped in conjunction with other disaster relief supplies. Families and individuals in tent cities are in desperate need of light to improve safety at night. Children need light at night to continue their studies. Lights according to the disclosed subject matter are a cost effective improvement over flashlights and kerosene lanterns. Lights according to the disclosed subject matter are also designed to provide light to individuals with little to no access to a functioning electrical grid. In developing nations, the World Bank estimates that families spend an average of 30% of their disposable income on kerosene lamps and other forms of non-renewable lighting. Lights according to the disclosed subject matter are designed to last 3-5 years. The money families are able to save will allow them to buy food and other necessities.

Figure 12:
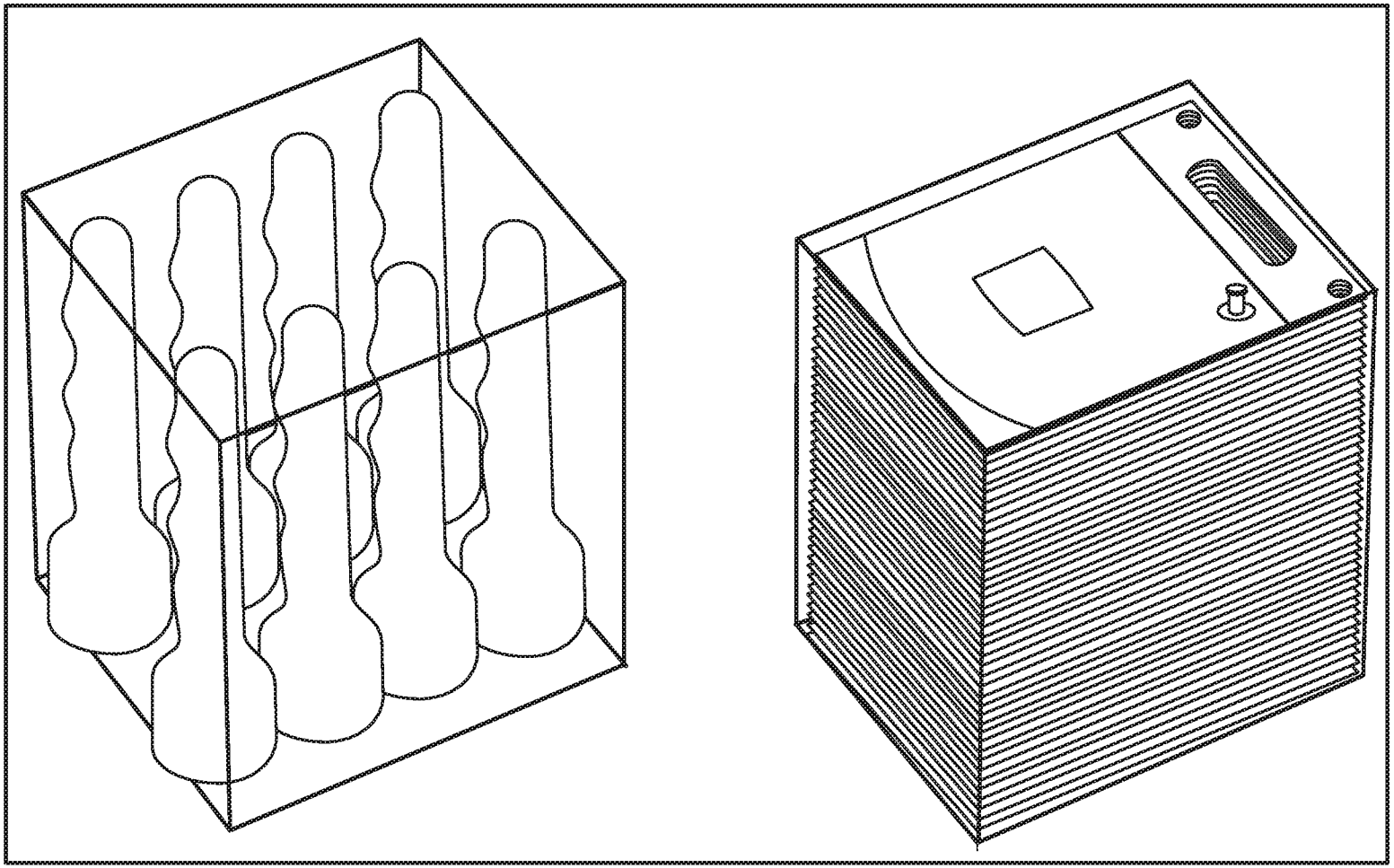
FIG. 12 is a front isometric view of a plurality of stacked solar-powered lights according to some embodiments of the disclosed subject matter in a flat state.

As shown in FIG. 12, when deflated, some embodiments of the disclosed subject matter are designed to fold up to a minimal volume (particularly when compared to conventional flashlights) that can be easily stored or transported. Still referring to FIG. 12, some embodiments of the disclosed subject matter are designed to be stored and shipped in large quantities cost effectively. Some embodiments of the disclosed subject matter are designed to fold to the size of a wallet and can fit easily within a first-aid kit or backpack. Some embodiments include closure mechanisms, e.g., snaps, hook and loop, or other, for retaining or holding the lights in a folded state. Some embodiments include a karabiner loop formed on the outside of the bladder to more easily attach the light to people and structures.

Lights according to the disclosed subject matter can be used by campers and hikers in outdoor uses as a rechargeable, easy transportable light source. They are waterproof and can be used in water sport activities, e.g., some embodiments include an inflatable ball with solar-led light attached to inside or outside surface. They can also be used as a household pool light.

In some embodiments, the inflatable bladder has a handle that contains a large hole for carrying and two smaller holes. This allows the light to be easily attached by a string or hook and hung from a backpack, the inside of a tent, a ceiling, etc. Lights according to the disclosed subject matter can also be tied to each other to form a string of lights.

Existing solar products have not been designed for disaster relief or emergency aid where distribution is a serious challenge. Lights according to the disclosed subject matter offer a solution because they are lightweight and cost-effectively shipped, transported, and distributed. Lights according to the disclosed subject matter are also useful for individuals who would like a solar-rechargeable light to keep in their home or in a first-aid kit in case of an emergency. Lights according to the disclosed subject matter have outdoor applications in boating, camping, and fishing. Lights according to the disclosed subject matter are lightweight, waterproof, pack flat, are extremely portable, and can be printed with patterns and logos.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. An expandable and contractable solar-powered light, comprising:

a bladder that defines an internal volume for receiving one or more of a gas, a liquid, or a solid, the internal volume having an internal surface, the bladder having a substantially transparent first panel, and a second panel that is positioned on an opposed side of the internal volume from the first panel, and a flat bottom panel that allows the solar-powered light to be positioned so as to stand in an upright position on the flat bottom panel; and a solar-powered light assembly with a cover portion that is substantially waterproof from an area around the light assembly, wherein the light assembly is adjacent to the first panel and includes:

a solar panel attached to a circuit board, a rechargeable battery to be charged by the solar panel, and at least one light-emitting diode attached to the circuit board to be powered by the rechargeable battery and positioned to provide light into the internal volume of the bladder through the substantially transparent first panel, wherein the circuit board is sealed between the cover portion and the first panel;

wherein the bladder is (a) substantially transparent, flexible, inflatable, and collapsible, and (b) capable of being contracted into a collapsed flat configuration, wherein the cover portion, the first panel, or both have substantially transparent zones so as to permit sunlight to reach the solar panel and light from the at least one light-emitting diode to reach the internal volume, and wherein the first panel, second panel, and circuit board lie flat adjacent each other when the bladder is in the collapsed flat configuration.

2. The light of claim 1, wherein the solar-powered light assembly is a single-piece unitary structure comprising the circuit board, the solar panel, the rechargeable battery, and the at least one light-emitting diode.

3. The light of claim 1, wherein the first panel and the second panel are each sealed along their outer peripheries.

4. The light of claim 1, wherein the outer peripheries of the first panel and the second panel are rectangular in shape.

5. The light of claim 1, where the outer periphery of the first panel is sealed to the outer periphery of the second panel.

6. An expandable and contractable solar-powered light, comprising:

a bladder that defines a first internal volume and having an internal surface defined at least in part by a first panel and a second panel that is positioned on an opposed side of the internal volume from the first panel, and a flat bottom panel that allows the solar-powered light to be positioned so as to stand in an upright position on the flat bottom panel; and a solar-powered light assembly that is disposed in a second internal volume that is separated from the first internal volume, the second internal volume defined at least by a cover portion that is substantially waterproof and substantially transparent, wherein the light assembly is attached to the first panel and includes:

a solar panel attached to a circuit board, a rechargeable battery connected to be charged by the solar panel, and at least one light-emitting diode attached to the circuit board to be powered by the rechargeable battery and positioned to provide light into the internal volume of the bladder through the first panel;

wherein the bladder is (a) substantially transparent, flexible, expandable, and collapsible, and (b) capable of being contracted into a collapsed flat configuration, wherein the solar-powered light assembly is sealed between the cover portion and the first panel, wherein the cover portion, the first panel, or both have substantially transparent zones so as to permit sunlight to pass to the solar panel and light from the at least one light-emitting diode to pass to the internal volume, and wherein the first panel, second panel, and circuit board lie flat adjacent each other when the bladder is in the collapsed flat configuration.

7. The light of claim 6, wherein each of the solar panel, the rechargeable battery, and the at least one light-emitting diode is positioned on the circuit board.

8. The light of claim 6, wherein the solar-powered light assembly comprises a plurality of light-emitting diodes.

9. The light of claim 8, further comprising a valve arranged on an exterior portion of the bladder, whereby the bladder can be inflated or deflated via the valve.

10. The light of claim 6, further comprising a power switch positioned on the circuit board and in electrical communication with the rechargeable battery and the light-emitting diodes, wherein the power switch is configured to control an amount of light emitted by the light.

11. The light of claim 10, wherein the power switch is arranged to provide power to the at least one light-emitting diode so as to light the at least one light-emitting diode at multiple different powered lighting levels.

12. An inflatable solar-powered light, comprising:

a bladder defining a first volume, the first volume for receiving one or more of a gas, a liquid, or a solid; and a solar-powered light assembly sealingly disposed within a second volume that is defined at least by a portion of the bladder and a substantially transparent sheet that covers the solar-powered light assembly, the solar-powered light assembly comprising a solar panel, a rechargeable battery to receive power from the solar panel, and at least one light-emitting diode to receive power from the rechargeable battery, and a circuit board connecting the solar panel, battery, and at least one light-emitting diode that is positioned to provide light into the first volume of the bladder through at least a portion of an exterior surface of the bladder, wherein the second volume is substantially waterproof, and wherein the second volume is separated from the first volume by at least a portion of the bladder;

wherein the bladder is substantially transparent, flexible, inflatable, and collapsible, is configured to diffuse light emitted from the at least one light-emitting diode, such that substantially the entire bladder is illuminated, and has a first panel that holds the solar-powered light assembly and a second panel across the volume from the first panel and against which the at least one light-emitting diode is directed, a flat bottom panel that allows the solar-powered light assembly to be positioned so as to stand in an upright position on the flat bottom panel, and wherein the first panel, second panel and circuit board lie flat against each other when the light is in a collapsed configuration, wherein the solar panel, rechargeable battery, circuit board, and at least one light-emitting diode are sealed between the substantially transparent sheet and the first panel.

13. The light of claim 12, wherein the bladder comprises a plastic material.

14. The light of claim 12, wherein each of the solar panel, the rechargeable battery, and the at least one light-emitting diode is positioned on the circuit board.

15. The light of claim 12, wherein the solar-powered light assembly comprises a plurality of light-emitting diodes.

16. The light of claim 12, further comprising a valve arranged on an exterior portion of the bladder, wherein the bladder can be inflated or deflated via the valve.

17. The light of claim 12, further comprising a power switch in electrical communication with the rechargeable battery and the at least one light-emitting diode, wherein the power switch is configured to control an amount of light emitted by the light.

18. The light of claim 17, wherein the power switch is positioned on the circuit board.

* * * * *